US007971773B2

(12) United States Patent
Wagner et al.

(10) Patent No.: US 7,971,773 B2
(45) Date of Patent: Jul. 5, 2011

(54) CARTON WITH SPOUT

(75) Inventors: Todd A. Wagner, Medina, OH (US); Sean Alan Moss, Parma, OH (US)

(73) Assignee: Graphic Packing International, Inc., Marietta, GA (US)

( * ) Notice: Subject to any disclaimer, the term of this patent is extended or adjusted under 35 U.S.C. 154(b) by 235 days.

(21) Appl. No.: 12/333,720

(22) Filed: Dec. 12, 2008

(65) Prior Publication Data

US 2009/0152338 A1 Jun. 18, 2009

Related U.S. Application Data

(60) Provisional application No. 61/013,830, filed on Dec. 14, 2007.

(51) Int. Cl.
*B65D 5/74* (2006.01)
*B65D 5/54* (2006.01)
*B31B 1/26* (2006.01)

(52) U.S. Cl. ..... 229/215; 229/221; 493/162

(58) Field of Classification Search ..... 229/215, 229/217, 221, 122.1; 493/162, 405; 221/302, 221/305

See application file for complete search history.

(56) References Cited

U.S. PATENT DOCUMENTS

| | | | | |
|---|---|---|---|---|
| 2,989,224 | A * | 6/1961 | Umanoff | 229/217 |
| 4,150,778 | A * | 4/1979 | Engdahl, Jr. | 229/215 |
| 5,110,042 | A * | 5/1992 | Hurden | 229/215 |
| 5,215,250 | A * | 6/1993 | Roccaforte | 229/215 |
| 5,259,552 | A | 11/1993 | Kuchenbecker | |
| 5,429,297 | A | 7/1995 | Walsh | |
| 5,445,316 | A | 8/1995 | Roccaforte | |
| 5,660,324 | A | 8/1997 | Rowland | |
| 5,678,755 | A | 10/1997 | Block | |
| 5,680,986 | A | 10/1997 | Botterman | |
| 6,120,184 | A | 9/2000 | Laurence et al. | |
| 6,152,360 | A | 11/2000 | Block et al. | |
| 6,227,440 | B1 | 5/2001 | Hart | |

(Continued)

FOREIGN PATENT DOCUMENTS

DE 4308047 A1 * 12/1993 ..... 229/215

(Continued)

OTHER PUBLICATIONS

PCT/US2008/086591—International Search Report and Written Opinion.

*Primary Examiner* — Gary E Elkins
(74) *Attorney, Agent, or Firm* — Womble Carlyle Sandridge & Rice, PLLC

(57) ABSTRACT

A carton for containing a dispensable material. The carton has a plurality of panels that extends at least partially around an interior of the carton. The plurality of panels comprises at least a first panel and a second panel foldably connected to the first panel at a fold line. A spout is at least partially formed in the first panel and the second panel. The spout is moveable between a closed position substantially preventing the removal of the dispensable material from the carton and an open position allowing removal of the dispensable material from the carton. The spout comprises a first spout panel formed from a portion of the first panel and a second spout panel formed from a portion of the second panel. The second spout panel is foldably connected to the first spout panel at at least a portion of the fold line.

33 Claims, 10 Drawing Sheets

U.S. PATENT DOCUMENTS

| | | | |
|---|---|---|---|
| 6,328,472 | B1 | 12/2001 | Laurence et al. |
| 6,386,438 | B1 | 5/2002 | Walsh et al. |
| 7,036,714 | B2 | 5/2006 | Walsh et al. |
| 7,210,612 | B2 | 5/2007 | Walsh et al. |
| 2003/0057266 | A1 | 3/2003 | Sedo |
| 2003/0144121 | A1 | 7/2003 | Walsh et al. |
| 2005/0224564 | A1 | 10/2005 | Walsh |
| 2006/0255109 | A1 | 11/2006 | Green |

FOREIGN PATENT DOCUMENTS

| | | | | | |
|---|---|---|---|---|---|
| EP | 466337 | A2 * | 1/1992 | ..... | 229/221 |
| EP | 529260 | A2 * | 3/1993 | ..... | 229/215 |
| EP | 530643 | A2 * | 3/1993 | ..... | 229/215 |
| WO | WO 2009/018400 | A2 | 2/2009 | | |

* cited by examiner

CARTON WITH SPOUT

CROSS-REFERENCE TO RELATED APPLICATION

This application claims the benefit of U.S. Provisional Application No. 61/013,830, which was filed on Dec. 14, 2007. The entire contents of the above-referenced provisional application are hereby incorporated by reference for all purposes as if presented herein in their entirety.

BACKGROUND OF THE DISCLOSURE

This disclosure relates generally to containers or cartons for containing a dispensable material, and more specifically to such cartons having a spout.

SUMMARY OF THE DISCLOSURE

In general, one aspect of the disclosure is generally directed to a carton for containing a dispensable material. The carton comprises a plurality of panels that extends at least partially around an interior of the carton. A spout is at least partially formed in two of the plurality of panels. The spout being moveable between a closed position substantially preventing removal of dispensable material from the carton and an open position allowing removal of the dispensable material from the carton. The spout comprises a first spout panel and a second spout panel foldably connected to the first spout panel.

In another aspect, the disclosure is generally directed to a carton for containing a dispensable material. The carton comprises a plurality of panels that extends at least partially around an interior of the carton. The plurality of panels comprises a first panel and a second panel foldably connected to the first panel at a fold line. A spout is at least partially formed in the first panel and the second panel. The spout being moveable between a closed position substantially preventing removal of dispensable material from the carton and an open position allowing removal of the dispensable material from the carton. The spout comprises a first spout panel formed from a portion of the first panel and a second spout panel formed from a portion of the second panel. The second spout panel is foldably connected to the first spout panel at at least a portion of the fold line.

In another aspect, the disclosure is generally directed to a blank for forming a carton for containing a dispensable material. The blank comprises a plurality of panels that comprises a first panel and a second panel foldably connected to the first panel at a fold line. A spout is at least partially formed in the first panel and the second panel. The spout is for being moveable between a closed position substantially preventing removal of dispensable material from the carton formed from the blank and an open position allowing removal of the dispensable material from the carton formed from the blank. The spout comprises a first spout panel formed from a portion of the first panel and a second spout panel formed from a portion of the second panel. The second spout panel is foldably connected to the first spout panel at at least a portion of the fold line.

In another aspect, the disclosure is generally directed to a method of forming a carton. The method comprises having a blank. The blank comprises a plurality of panels that comprises a first panel and a second panel foldably connected to one another at a fold line. A spout is at least partially formed in the first panel and the second panel. The spout is moveable between a closed position substantially preventing removal of dispensable material from the carton formed from the blank and an open position allowing removal of the dispensable material from the carton formed from the blank. The spout comprises a first spout panel formed from a portion of the first panel and a second spout panel formed from a portion of the second panel. The second spout panel is foldably connected to the first spout panel at at least a portion of the fold line. The method further comprises folding the blank to form a carton. The folding the blank comprises positioning the plurality of panels to form an interior space. The method further comprises filling the interior space with a dispensable material.

In another aspect, the disclosure is generally directed to a carton for containing a dispensable material. The carton comprises a plurality of panels that extends at least partially around an interior of the carton. The plurality of panels comprises a first panel and a second panel foldably connected to the first panel at a fold line. A spout is at least partially formed in the first panel and the second panel. The spout is moveable between a closed position substantially preventing removal of dispensable material from the carton and an open position allowing removal of the dispensable material from the carton. The spout comprises a first spout panel formed from a portion of the first panel and a second spout panel formed from a portion of the second panel. The second spout panel is foldably connected to the first spout panel at at least a portion of the fold line. The at least a portion of the fold line is located at a corner of the carton. The first spout panel is foldably connected to the first panel at a spout fold line. The spout fold line intersects the at least a portion of the fold line at a junction.

Those skilled in the art will appreciate the above-stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

Exemplary embodiments of the present disclosure provide a carton or container having a spout or a pour spout, and a method of constructing the same. In one embodiment, the container is a carton fabricated from a corrugated material. The carton, however, may be fabricated using any suitable material, and therefore is not limited to a specific type of material. In alternative embodiments, the carton is fabricated using paperboard, cardboard, plastic and/or any suitable material known to those skilled in the art and guided by the teachings herein provided. Moreover, the carton may have any suitable size, shape and/or configuration.

The present disclosure generally relates to constructs, sleeves, container, cartons, or the like, and packages for holding and dispensing material such as dispensable materials that can include products such as food products (e.g., cereal, oatmeal, rice, sweetener, or any other food product), or other non-food products (e.g., cat litter, detergent, or any other product). In this specification, the terms "lower," "bottom," "upper" and "top" indicate orientations determined in relation to fully erected cartons.

Figure 1:
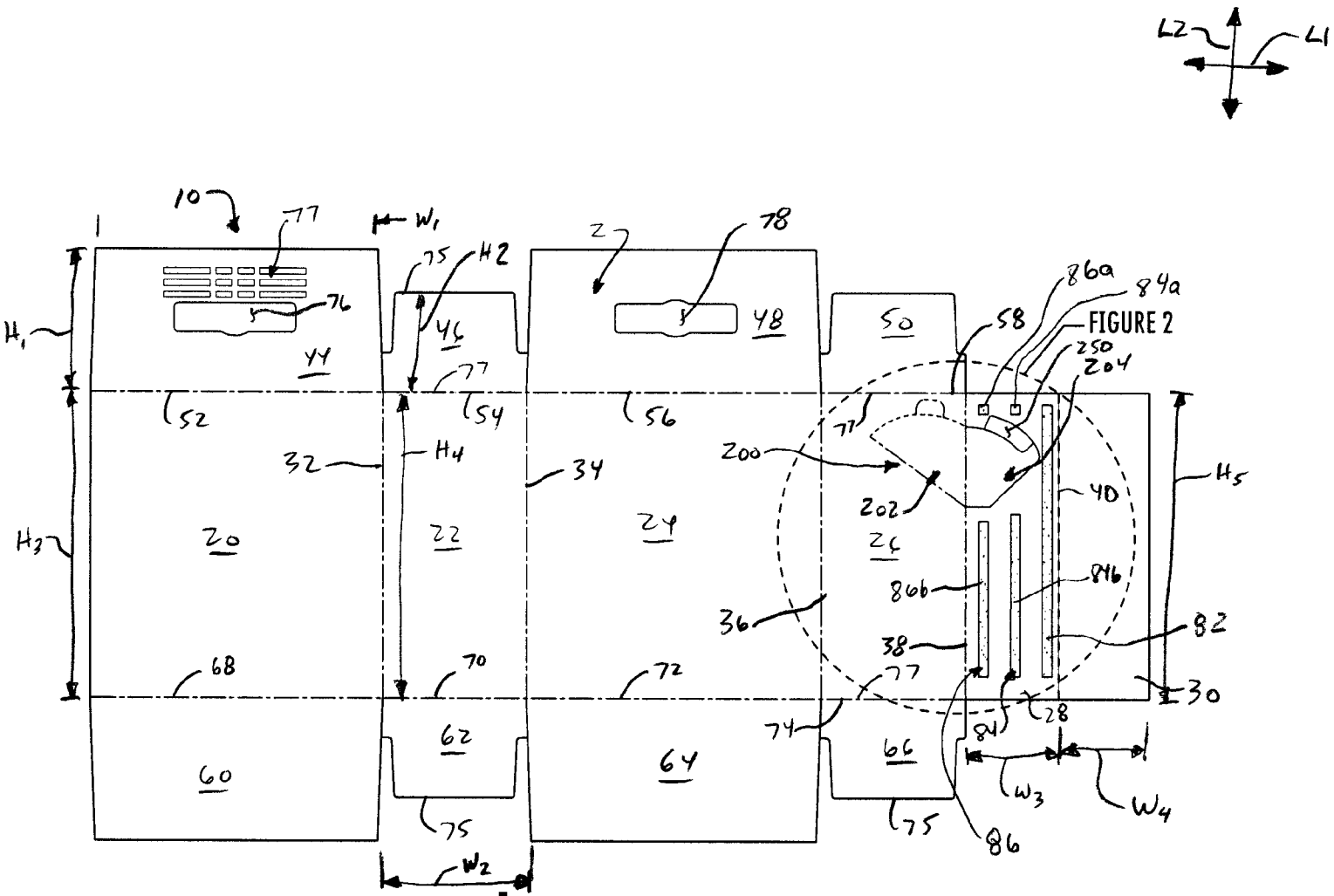
FIG. 1 is a plan view of an exterior surface of a blank of a first exemplary embodiment of the disclosure.

FIG. 1 is a plan view of an exterior surface 2 of a blank 10 of a first exemplary embodiment of the disclosure. The blank 10 is for forming a carton 100 (shown in FIG. 7) having a spout 200. Although the blank 10 may include any suitable material without departing from the scope of the present disclosure, in one embodiment the blank includes cardboard, corrugated board, and/or plastic. The spout 200 is positionable between a closed position (FIG. 7) preventing removal of a dispensable material from the carton 100 and an open position (FIG. 8) allowing removal of the dispensable material from the carton. In the illustrated embodiment, the carton 100 is generally parallelepipedal-shaped with the spout being formed in a corner 11 of the carton 100, but the carton could be otherwise shaped and the spout could be otherwise located, arranged, and positioned without departing from the disclosure.

The blank 10 has a longitudinal axis L1 and a lateral axis L2. The blank 10 may include indicia on the exterior surface 2. In the illustrated embodiment, the blank 10 comprises a plurality of adjacent substantially rectangular panels 20, 22, 24, 26, 28, 30 that are connected together by a plurality of preformed, generally parallel, lateral fold lines 32, 34, 36, 38, 40, respectively. Specifically, the rectangular panels include a first side panel 20, a first end panel 22, a second side panel 24, a second end panel 26, a first support panel 28, and a second support panel 30. First end panel 22 is foldably connected to the first side panel 20 at the lateral fold line 32. The second side panel 24 is foldably connected to the first end panel 22 at the lateral fold line 34. The second end panel 26 is foldably connected to the second side panel 24 at the lateral fold line 36. The first support panel 28 is foldably connected to the second end panel 26 at the lateral fold line 38. The second support panel 30 is foldably connected to the first support panel 28 at the lateral fold line 40. Further, in the exemplary embodiment, the second support panel 30 has a thickness that is smaller than a thickness of the remainder of the blank 10 (e.g., the panels 20, 22, 24, 26, 28). Alternatively, the second support panel 30 could have the same thickness or a greater thickness as the remainder of the blank 10 without departing from the disclosure. In an alternative embodiment, the blank 10 can have any number of panels, wherein each panel has any suitable shape and/or size that enables carton 100 to function as described herein.

As shown in FIG. 1, each of the panels 20, 22, 24, 26 includes a respective top end flap 44, 46, 48, 50 foldably connected thereto at a respective longitudinal fold line 52, 54, 56, 58. Similarly, each of the panels 20, 22, 24, 26 includes a respective bottom end flap 60, 62, 64, 66 foldably connected thereto at a respective longitudinal fold line 68, 70, 72, 74. In the exemplary embodiment, the end flaps 46, 50, 62, 66 have arcuate side edges such that the arcuate side edges facilitate ease of assembly of the carton 100. More specifically, each end flap 46, 50, 62, 66 narrows at a distal end 75 with respect a base end 77. The base end 77 is formed at one of the respective longitudinal fold lines 54, 58, 70, 74. The longitudinal fold lines 52, 54, 56, 58 connecting a respective top end flap 44, 46, 48, 50 could be a single continuous fold line or the fold lines could be otherwise shaped, arranged, and/or configured without departing from the disclosure. The longitudinal fold lines 68, 70, 72, 74 connecting a respective bottom end flap 60, 62, 64, 66 could be a single continuous fold line or the fold lines could be otherwise shaped, arranged, and/or configured without departing from the disclosure.

In the exemplary embodiment, the top end flaps 44 and 48 include substantially rectangular openings 76, 78 wherein the opening 76 is smaller than the opening 78. Moreover, the top end flap 44 includes three substantially parallel score lines 77 positioned outward of the opening 76. In the exemplary embodiment, a handle 81 (shown in FIG. 7) can be attached to the interior surface of the panel 44 such that handle extends through the openings 76, 78 when the blank 10 is assembled into the carton 100. A user may transport the carton 100 using the handle 81. In an alternative embodiment, the openings 76, 78 are any suitable size and/or shape that enables the carton 100 to function as described herein. In an alternative embodiment, the handle 81 may be omitted or can be any mechanism that enables a user to transport and/or carry the carton 100. For example, the handle 81 could comprise a panel or a portion of one or more of the top end flaps 44, 48 that can be separated from the blank 10 and used for grasping the carton 100 when the blank is formed into the carton.

Also, in the exemplary embodiment, the end flaps 44, 48, 60, 64 have a height $H_1$ and a width $W_1$. The end flaps 46, 50, 62, and 66 have a height $H_2$ and a width $W_2$ at the base end 77, wherein the height $H_2$ is less than the height $H_1$, and the width $W_2$ is less than the width $W_1$. Alternatively, the end flaps 46, 50, 62, 66 may have a height $H_1$ and/or a width $W_2$. Similarly, in the exemplary embodiment, the first side panel 20 and the second side panel 24 each have a width $W_1$, and the first end panel 22 and the second end panel 26 each have a width $W_2$. Further, in the exemplary embodiment, the first support panel 28 has a width $W_3$ that is less than the widths $W_1$ and $W_2$, and the second support panel 30 has a width $W_4$ that is less than the widths $W_1$ and $W_2$, and is approximately equal to the width $W_3$. In an alternative embodiment, the width $W_4$ can be greater than or less than the width $W_3$. In the exemplary embodiment, first side panel 20 and the second side panel 24 each have a height $H_3$, and the first end panel 22 and the second end panel 26 each have a height $H_4$, wherein the height $H_3$ is greater than the height $H_4$. The first support panel 28 and the second support panel 30 each have a height $H_5$ defined between a first longitudinal edge 79 and a second longitudinal edge 83 of the blank 10. In the exemplary embodiment, the height $H_5$ is less than the height $H_4$. Alternatively, the heights $H_3$, $H_4$, and $H_5$ can be substantially equal. Further, in the exemplary embodiment, the sum of the height $H_1$ and the height $H_2$ is less than the height $H_3$. Each of the panels 20, 22, 24, 26, 28, 30 and/or the end flaps 44, 46, 48, 50, 60, 62, 64, 66 can be otherwise sized, shaped, and/or configured, including any height and any width, without departing from the disclosure.

Figure 3:
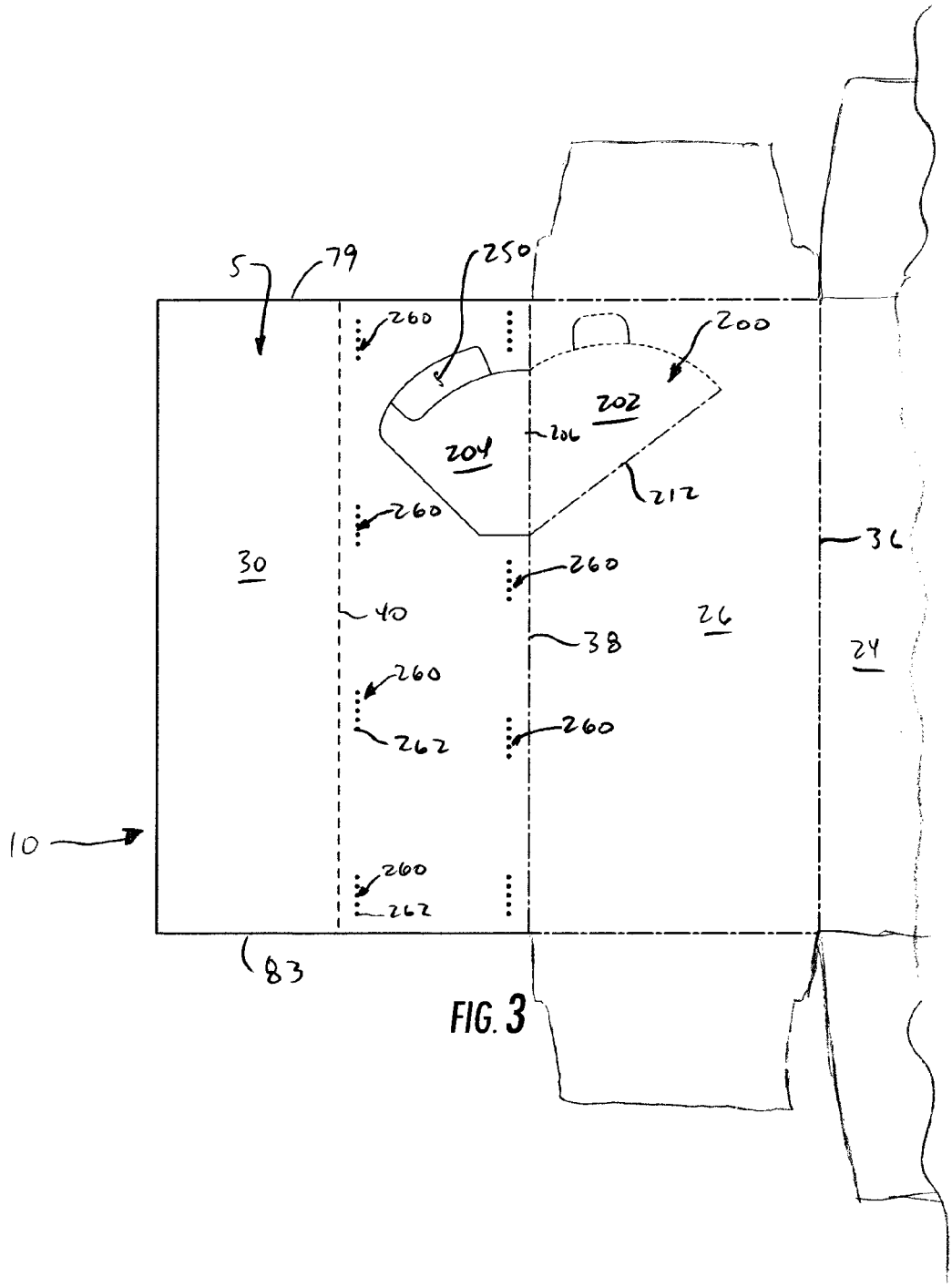
FIG. 3 is a plan view of an interior surface of a portion of the blank shown in FIG. 1.

In the exemplary embodiment, the blank 10 includes glue strips 82, 84, 86 positioned on the exterior surface 2 of the first support panel 28. In the exemplary embodiment, the glue strips 82, 84, 86 are substantially parallel, but one or more of the glue strips could be otherwise positioned or could be omitted without departing from the disclosure. The first glue strip 82 is positioned substantially parallel to and adjacent the fold line 40, and extends substantially between the longitudinal edge 79 and the longitudinal edge 83 of the blank 10. Each of the second and third glue strips 84, 86 includes a respective first portion 84*a*, 86*a* and a respective second portion 84*b*, 86*b* separated from the first portion. The first and second portions 84*a*, 86*a*, 84*b*, 86*b* of the glue strips 84 and 86 are respectively separated such that the first portions are positioned above the spout 200 and the second portions are positioned below the spout. In the illustrated embodiment, the spout 200 is free from contact with any portion of the glue strips 82, 84, 86. In one embodiment, the glue strips 82, 84, 86 are adhesive strips, but the glue strips can comprise any suitable material and/or mechanism having any shape and/or size. The blank 10 includes lines 260 of pinholes 262 (FIG. 3) in the first support panel 28 that do not extend through the thickness of the blank 10. The lines 260 are aligned to correspond with the location of the glue strips 82, 86 on the exterior surface 2 of the first support panel 28. In an alternative embodiment, the interior surface 5 includes at least one glue strip (not shown) that is positioned on a portion of interior surface of the first support panel 28.

Figure 2:
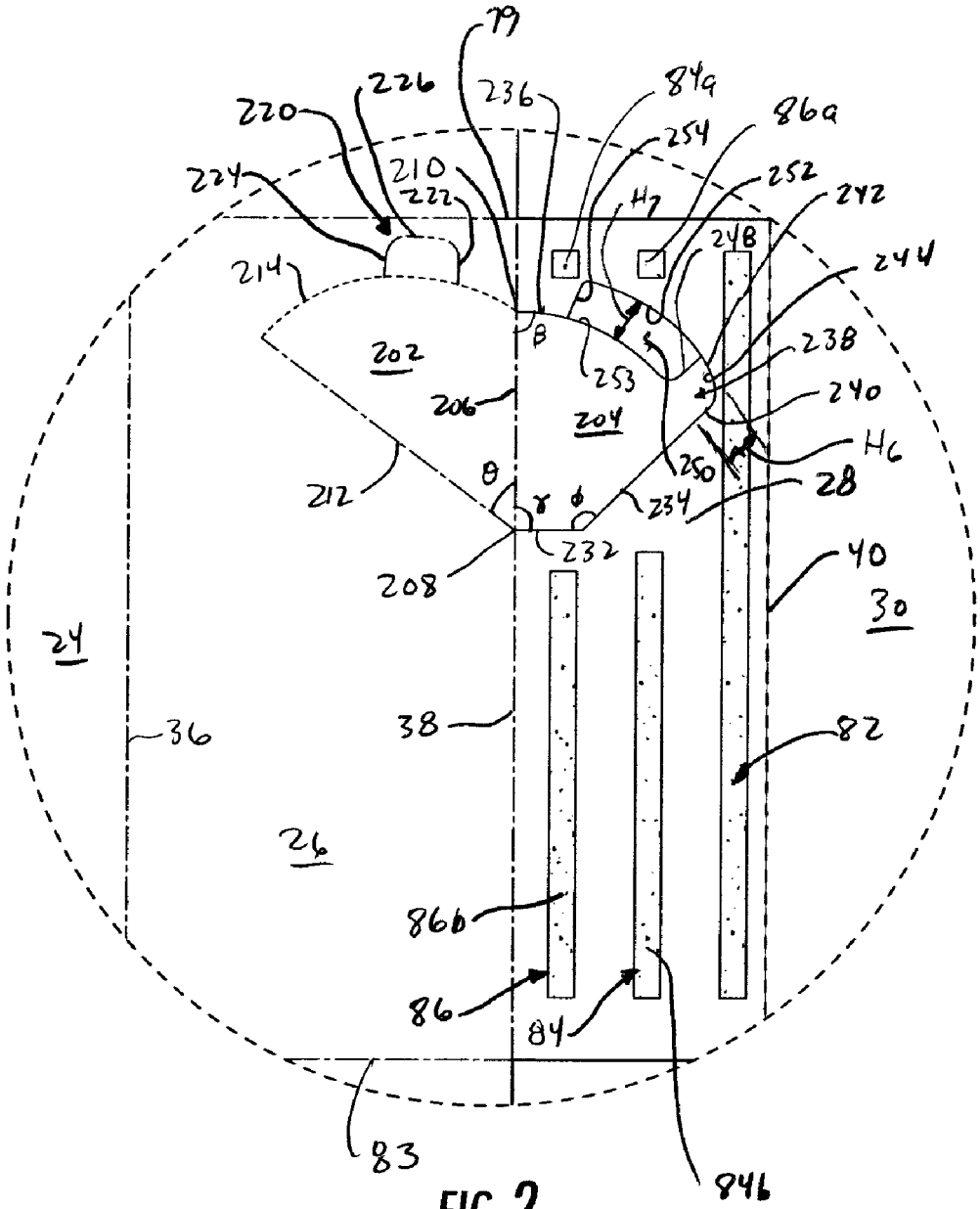
FIG. 2 is an enlarged portion of the blank shown in FIG. 1.

As shown in FIGS. 1 and 2, the spout 200 includes a first spout panel 202 formed from a portion of the second end panel 26 and a second spout panel 204 formed from a portion of the first support panel 28. The first spout panel 202 is foldably connected to the second spout panel 204 at a portion 206 of the lateral fold line 38. Referring to FIG. 2, the portion 206 of the fold line 38 has a first end 208 and an opposing second end 210.

In the illustrated embodiment, the first spout panel 202 is generally triangular-shaped and is defined at least partially by the portion 206 of the lateral fold line 38.

The first spout panel 202 is further defined by an oblique fold line 212 (broadly "spout fold line") and a curved line of separation 214 (e.g., tear line). The spout fold line 212 extends outward from a junction at the intersection of the spout fold line with the end 208 of the portion 206 of the fold line 38. In one embodiment, the spout fold line 212 forms an acute angle θ relative to the portion 206 of the lateral fold line 38. The curved tear line 214 extends between an end of the spout fold line 212 and the end 210 of the portion 206 of the lateral fold line 38. In the embodiment of FIGS. 1 and 2, the tear line 214 is curved, but the tear line could be otherwise shaped and/or arranged (e.g., straight). Furthermore, the angle θ between the spout fold line 212 and the portion 206 of the lateral fold line 38 could be otherwise sized to be more or less than illustrated without departing from the disclosure.

In the illustrated embodiment, the blank 10 includes an access panel 220 in the second end panel 26 that is configured to separate from the carton 100 when a user applies pressure to the access panel. The access panel 220 is positioned adjacent the curved tear line 214 that defines the first spout panel 202. In the illustrated embodiment, the access panel 220 includes a first curvilinear line of separation 222 (e.g., tear line) extending from the tear line 214, and a second curvilinear line of separation 224 (e.g., tear line) extending from the tear line 214. In one exemplary embodiment, the access panel 220 is foldably connected to the second end panel 26 at a fold line 226 extending at least partially between the lines of separation 222, 224. The access panel 220 can be otherwise shaped, arranged, configured, and/or omitted without departing from the disclosure. For example, in one alternative embodiment, the lines of separation 222 and 224 can be straight. The access panel 220 can be folded inward at the fold line 226 from a closed position (FIG. 2) to an inwardly pressed position (FIG. 7) allowing access to a top edge of the first spout panel 202.

In the illustrated embodiment, the second spout panel 204 is generally triangular-shaped and is defined at least partially by the portion 206 of the lateral fold line 38. The second spout panel 204 is further defined by a first line of separation 232 (e.g., longitudinal tear line), a second line of separation 234 (e.g. oblique tear line), a third line of separation 236 (e.g., curved tear line), a fourth line of separation 242 (e.g., curved tear line), and an opening 250 (e.g., cut out) in the first support panel 28. The longitudinal tear line 232 extends outward from a junction or intersection at the end 208 of the portion 206 of the fold line 38 where the spout fold line 212, fold line 38, and longitudinal tear line 232 meet. The longitudinal tear line 232 forms a substantially perpendicular angle y relative to the portion 206 of the lateral tear line 38. In the illustrated embodiment, the longitudinal tear line 232 is substantially parallel to the first and second edges 79 and 83 of the first support panel 28, but the tear line 232 could be otherwise shaped, arranged, and/or positioned without departing from the disclosure.

As shown in FIG. 2, the oblique tear line 234 extends outward from the longitudinal tear line 232 and forms an obtuse angle ϕ relative to the longitudinal tear line. The curved tear line 242 extends from an end of the oblique tear line 234 to the opening 250. The curved tear line 236 extends from a junction at the end 210 of the portion 206 of the lateral fold line 38, where the curved tear line 214, the fold line 38, and the curved tear line 236 meet, to the opening 250. In the illustrated embodiment, the curved tear line 236 forms an acute angle β relative to the portion 206 of the lateral fold line 38. The tear lines 232, 234, 236, 242 forming the second spout panel 204 can be otherwise shaped, arranged, and/or configured. In an alternative embodiment, the angles γ, ϕ, and β are any size angles that can be more or less than the angles illustrated or described herein.

In the illustrated embodiment, the second spout panel 204 further includes a retention tab 238 generally located at a corner of the second spout panel. In one embodiment, the retention tab 238 is generally square-shaped. The retention tab 238 is partially defined by the oblique tear line 234 defining a first side edge 240 of the retention tab 238, the curved tear line 242 defining a top edge 244 of the retention tab 238, and a second side edge 248 of the retention tab 238 that is adjacent the opening 250. In the exemplary embodiment, the top edge 244 is substantially perpendicular to the first side edge 240 and the second side edge 248. Further, the retention tab 238 has a height $H_6$ above the line of separation 236. The retention tab 238 can be otherwise shaped, arranged, configured, and/or omitted.

In the illustrated embodiment, the opening 250 is adjacent an edge 248 of the second spout panel 204 and is located between the curved tear line 236 and the retention tab 238. The opening 250 is sized to receive the retention tab 238 when the spout 200 is opened. The opening 250 is defined by two generally parallel curved side edges 252, 253, a first end edge 254 adjacent an end of the curved tear line 236, and a second end edge corresponding to the second side edge 248 forming the retention tab 238. The opening 250 has a height $H_7$ between the two curved edges 252, 253 that is greater than the height $H_6$ of the retention tab 238 so that the retention tab is free to move in the opening. In the illustrated embodiment, the opening 250 is generally trapezoidal-shaped, but the opening 250 could be otherwise sized, shaped, and configured without departing from the disclosure.

An example of a suitable method of forming the carton 100 from the blank 10 will now be described. In the illustrated embodiment, the carton 100 is assembled by rotating the panel 30 along fold line 40 towards the interior surface of the panel 28. The interior surface 5 of the panel 30 is adhesively coupled to interior surface of the panel 28, wherein at least a portion of the panel 30 is positioned over a portion of the spout 200. In the exemplary embodiment, the panel 30 is in face-to-face contact with the interior surface of panel 28. Moreover, panels 20, 22, 24, 26, 28 can be rotated along fold lines 32, 34, 36, 38, respectively, and the first support panel 28 is adhesively attached to a portion of the first side panel 20 with glue strips 82, 84, and 86. The first support panel 28 is attached to the first side panel 20 in a manner such that the exterior surface 2 of the first side panel 28 is in face-to-face contact with a portion of the interior surface 5 of the first side panel 20. In one embodiment, the first side panel 20 and that the second support panel 30 cooperate to form a sleeve 273 (e.g., receptacle) (FIGS. 8 and 9) that retains the second spout panel 204 of the spout 200 in a generally perpendicular position relative to the first spout panel 202 when the carton 100 is assembled. The sleeve 273 formed by the first side panel 20 and the second support panel 30 allows sliding movement of the second spout panel 204 in the sleeve when the spout 200 is rotated between the closed and open positions.

When the second support panel 28 is secured to the first side panel 20, the partially assembled carton 100 forms a generally open-ended tubular structure partially enclosing the interior space 314 of the carton. The bottom end 103 of the carton 100 can be closed by overlapping and adhering the bottom end flaps 60, 62, 64, 66. The top end 105 of the carton 100 can be closed by overlapping and adhering the top end flaps 44, 46, 48, 50. Dispensable material (not show) can be added to the interior space 314 of the carton 100 after closing one or both of the top and bottom ends 105, 103. The dispensable material can be contained in a bag (not shown) or liner, or the dispensable material can be in contact with the interior surface 5 of the carton 100. The carton 100 can be formed and filled with dispensable material by other forming and/or filling steps, or the steps described herein can be changed, modified, or omitted without departing from the disclosure.

As shown in FIGS. 7-10, the carton 100 formed from the blank 10 is generally parallelepipedal-shaped and has a back end wall 302, a front end wall 306, a first side wall 301, a second side wall 304, a top wall 310, and a bottom wall 312. The back end wall 302 is formed by the end panel 22, the front end wall 306 is formed by the end panel 26, the side wall 301 is formed by the side panel 20 with the overlapped and adhere first and second support panels 28, 30 attached thereto, and the side wall 304 is formed by the side panel 24. The top wall 310 is formed by the top end flaps 44, 46, 48, 50, and the bottom wall 312 is formed by the bottom end flaps 60, 62, 64, 66. The junction of the front end wall 306 and the first side wall 301 forms the corner 11 of the carton 100. The corner 11 corresponds with the location of an edge of the side panel 20 and the lateral fold line 38. As discussed further below, the spout 200 is opened by folding the first spout panel 202 downward from the closed position of FIG. 7 so that the second spout panel 204 is withdrawn from the sleeve 273 at the corner 11 of the carton 100.

Figure 8:
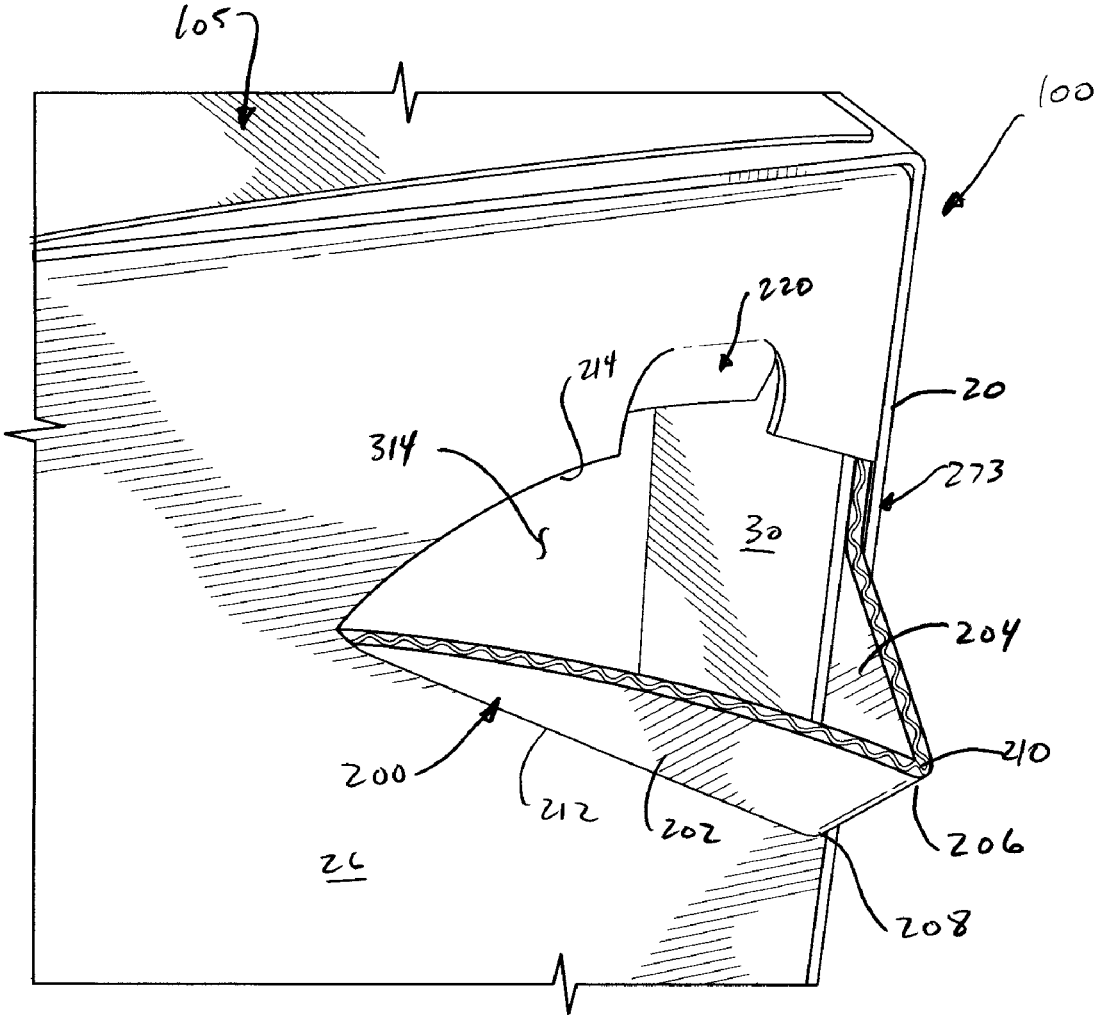
FIG. 8 is an enlarged perspective view of a portion of the carton of FIG. 7 with the spout shown in an open position.
Figure 9:
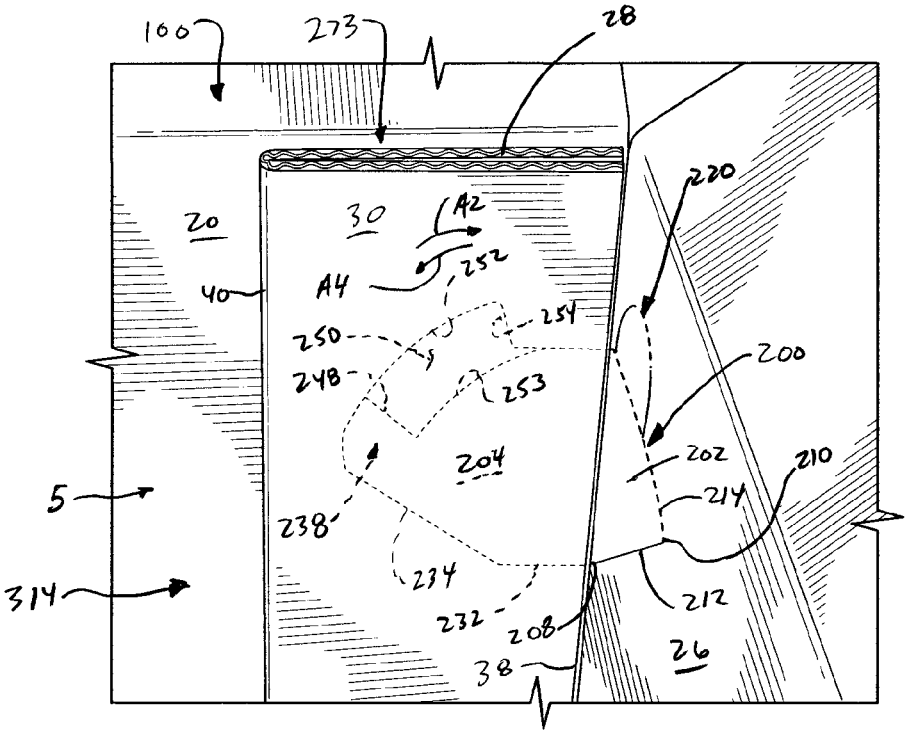
FIG. 9 is a perspective of the interior of the carton formed from the blank of FIG. 1 with the spout in the closed position.
Figure 10:
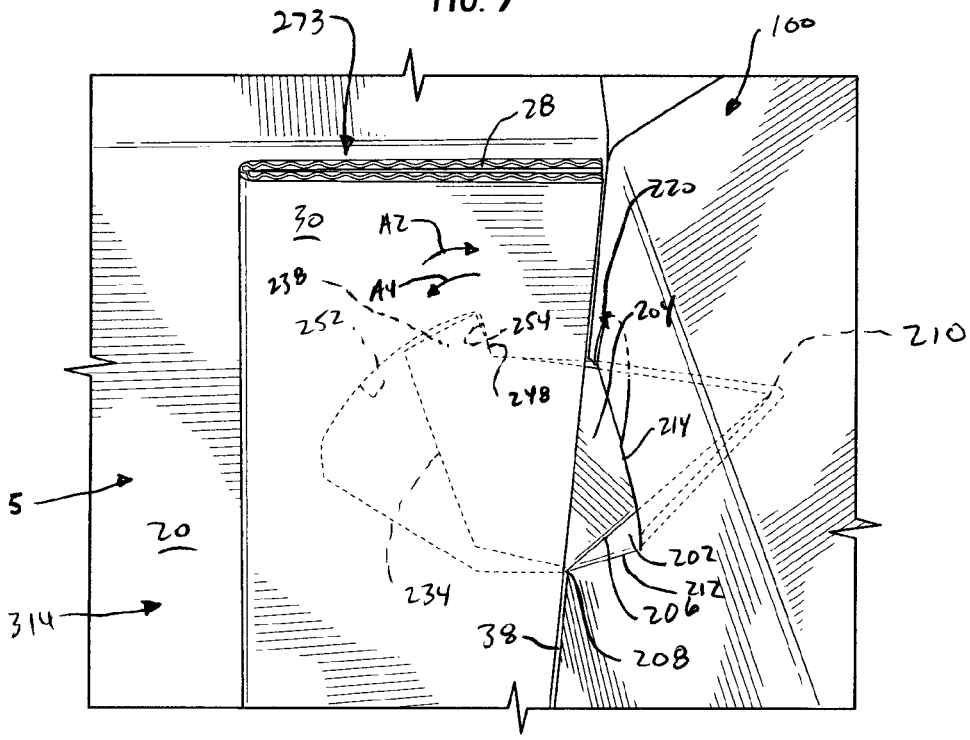
FIG. 10 is a perspective of the interior of the carton of FIG. 9 with the spout in the open position.

An example of a suitable method of dispensing material from the carton 100 will now be described. The spout 200 is positionable between a closed position (FIGS. 7 and 9) preventing the flow of dispensable material through the spout, and an open position (FIGS. 8 and 10) allowing the flow of dispensable material through the spout. In FIGS. 9 and 10, some of the features that are hidden from view are schematically illustrated by dashed lines.

In the closed position, the first spout panel 202 is positioned substantially flush with and in planar relationship with the first end panel 26, and the second spout panel 204 is positioned in the withdrawn position from the sleeve 273 (FIG. 9). The access panel 220 is detachable from the panel 26 along at least a portion of a periphery thereof in response to force exerted by a finger of a user. The user applies pressure to the access panel 220 to fold the access panel inward to allow access to the top edge of the first spout panel 202. The top edge of the first spout panel 202 is separated from the end panel 26 by tearing along tear line 214. Next, the spout 200 is further initially separate from the blank 10 by applying a force to the first spout panel 202 to initiate movement of the spout and separation of the second spout panel 204 from the first support panel 28. For example, when the first spout panel 202 is pulled outward from the end wall 306, the second spout panel 204 is torn along tear lines 232, 234, 236, 242. After the spout 200 has been separated from the end panel 26 and the first support panel 28, a user may rotate the spout 200 from the closed position to the open, dispensing position. The first spout panel 202 rotates outward in the direction of arrow A1 (FIG. 7) and away from the interior cavity 314 of the carton 100 along the spout fold line 212. As the first spout panel 202 rotates along fold line 212, the spout second panel 204 rotates substantially simultaneously in the direction of arrow A2 (FIGS. 9 and 10) about the junction at the end 208 of the portion 206 of the lateral fold line 38. As the second spout panel 204 rotates in the direction of arrow A2, the retention tab 238 slides within the opening 250. The top edge 244 of the retention tab 238 is shaped and configured to slide along the edge 252 of the opening 250. In the fully open position (FIGS. 8 and 10), the edge 248 of the retention flap 238 contacts the edge 254 of the first support panel 28 forming the opening 250 to prevent further withdrawal of the spout 200 from the carton 100. In the illustrated embodiment, the edge 254 of the first support panel 28 is a stopper surface that engages the edge 248 of the retention tab 238 to prevent the spout 200 from being further withdrawn past the open position of the spout. The spout 200 and the first support panel 28 with the opening 250 could be otherwise shaped, arranged, and/or configured to provide a stopper surface to prevent withdrawal of the spout from the carton 100.

After opening the spout 200 and removing the dispensable material through the spout, the spout can be pivoted from the open position to the closed position by pushing the first spout panel 202 upward in the direction of arrow A3 (FIG. 8) to pivot the first spout panel about spout fold line 212. When the spout 200 is moved to the closed position, the second spout panel 204 pivots in the direction of arrow A4 (FIGS. 9 and 10) about the end 208 of the portion 206 of the lateral fold line 38 back to the closed position shown in FIG. 9. The second spout panel 204 is withdrawn from the sleeve 273 when the spout is pivoted to the closed position. The spout 200 can be selectively opened and closed in the manner described herein when needed by the user. Further, the spout 200 can be articulated between intermediate positions between the fully open position (FIGS. 8 and 10) and the fully closed position (FIGS. 7 and 9) without departing from the scope of the disclosure. The spout 200 can be opened and/or closed by other positioning steps and/or methods, and the spout 200 could have other features without departing from the disclosure.

Typically, when the spout 200 is moved between its open and closed positions, and vice-versa, there is some relative pivoting between the first and second spout panels 202, 204 along the portion 206 of the lateral fold line 38.

Figures 4, 5:
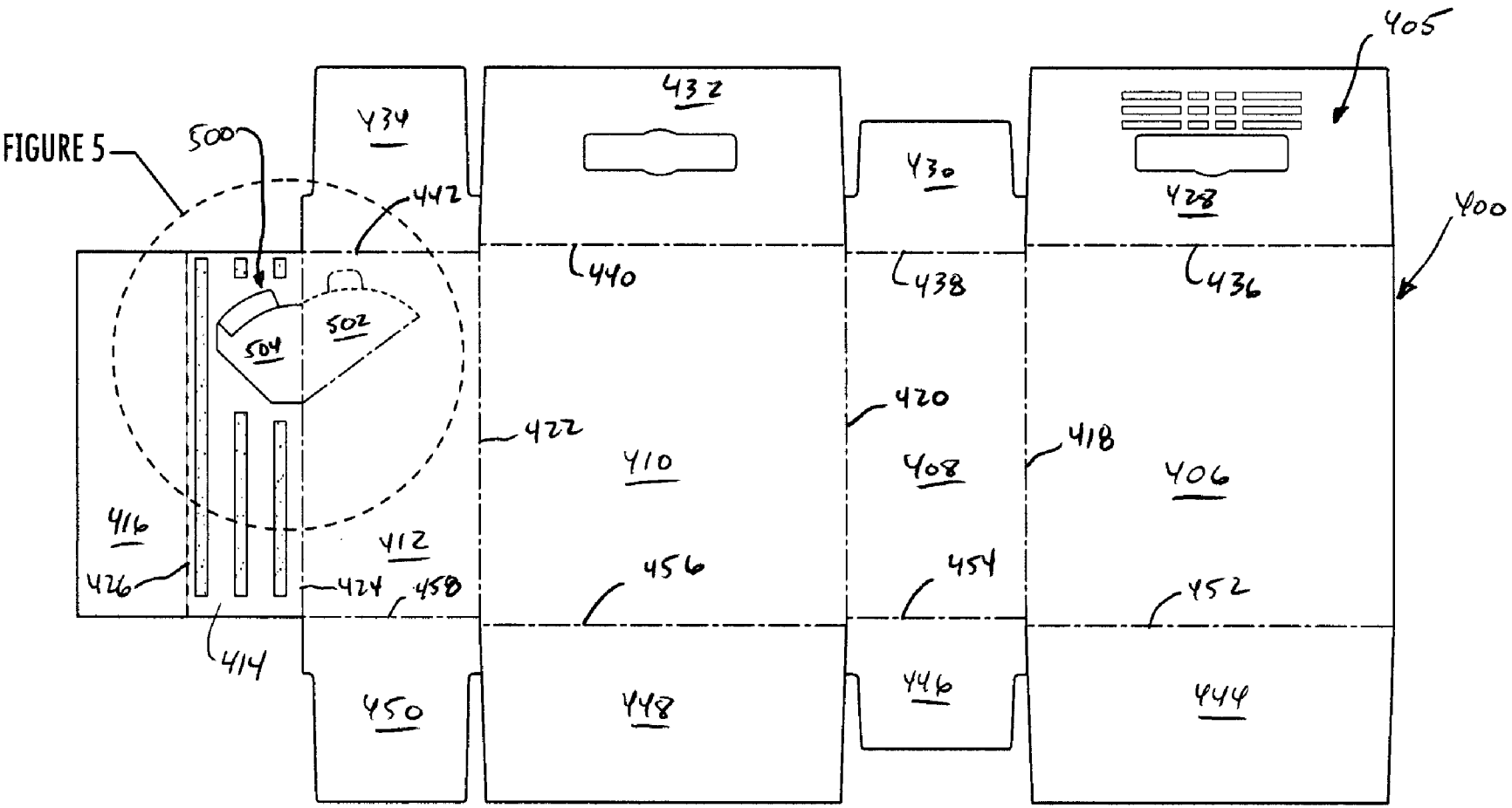
FIG. 4 is a plan view of an interior surface of a blank of a second exemplary embodiment of the disclosure.
FIG. 5 is an enlarged portion of the blank shown in FIG. 4.
Figure 5:
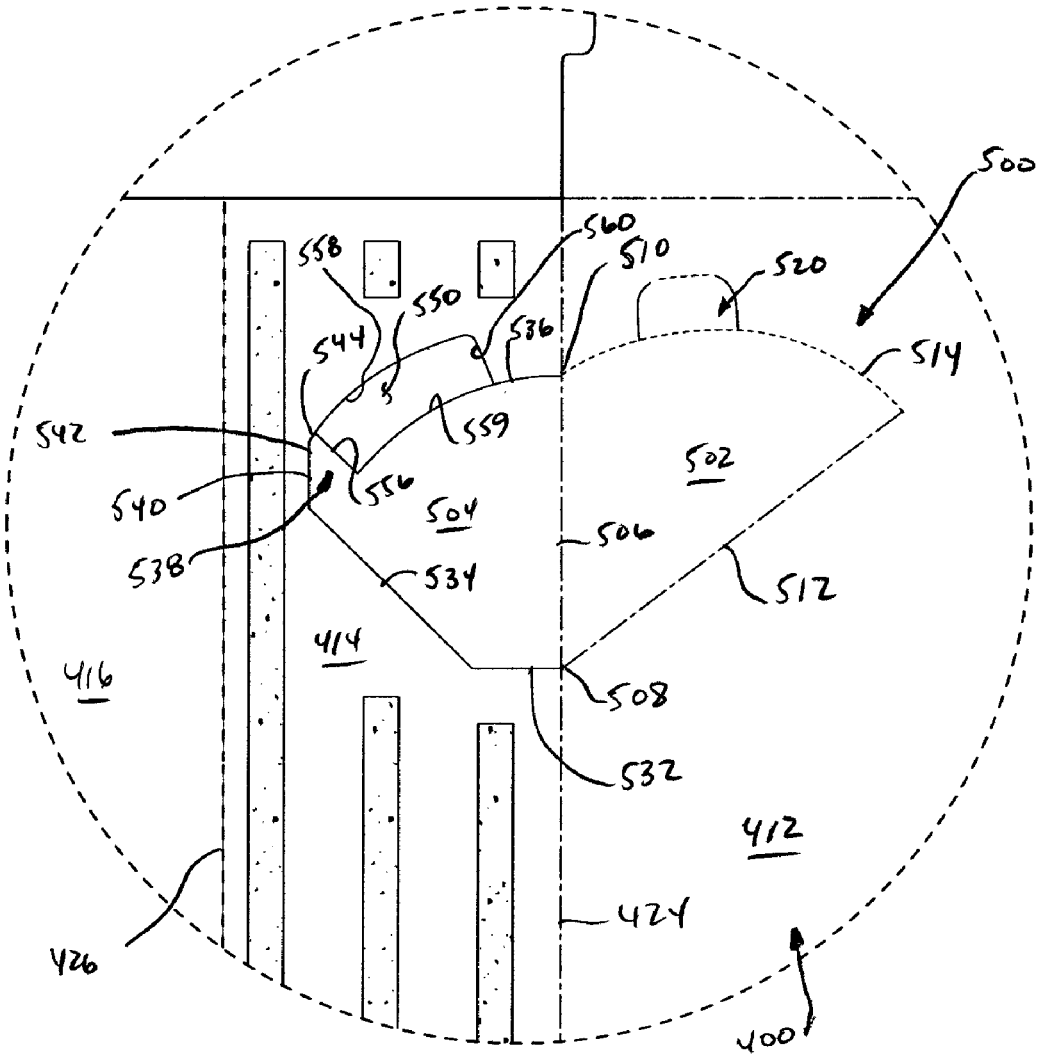
Figure 7:
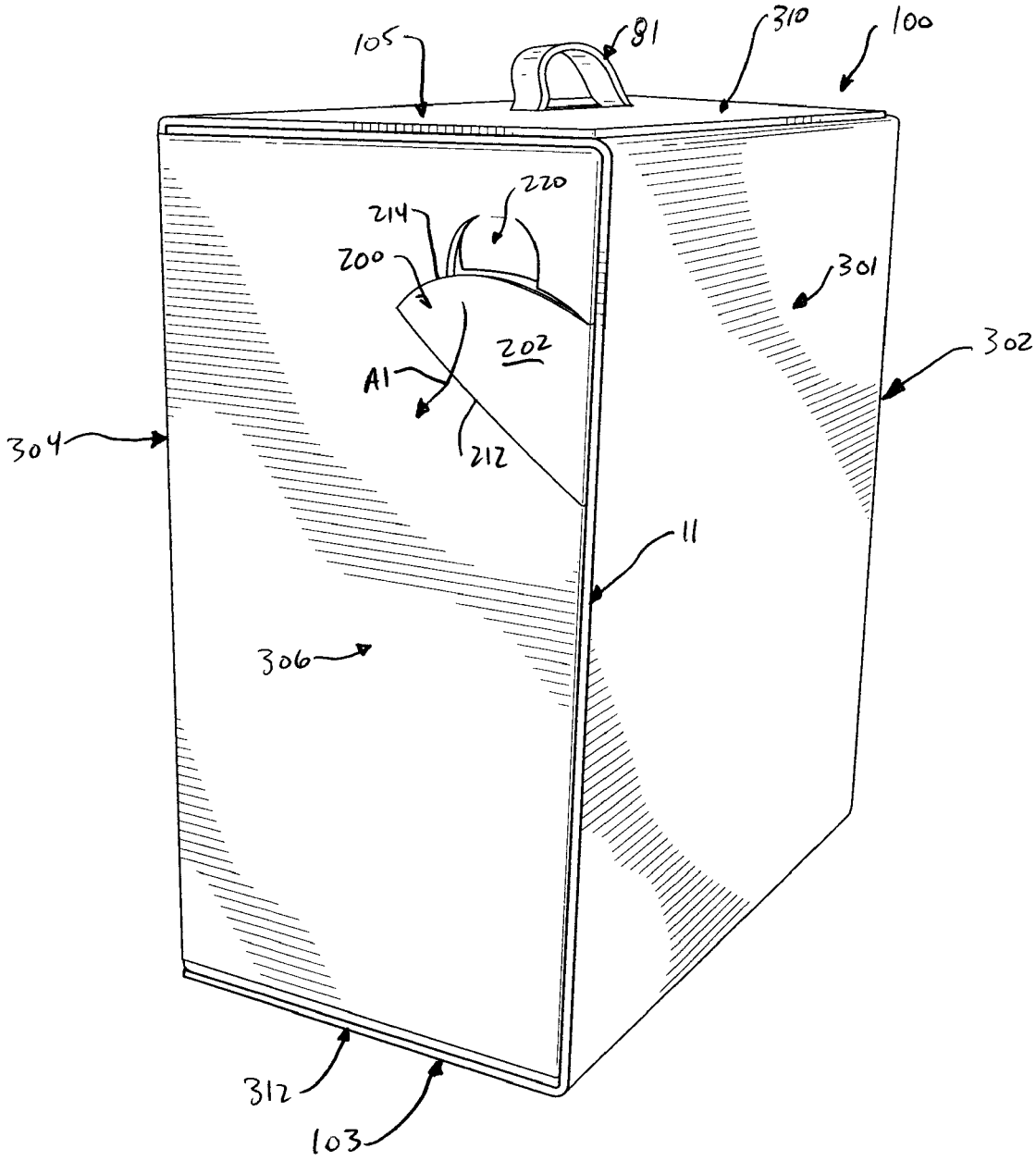
FIG. 7 is a perspective view of a carton formed from the blank shown in FIG. 1 with a spout in a closed position.

FIG. 4 is a top plan view of a blank 400 of a second embodiment that can be used to form the carton 100 (shown in FIG. 7). The blank 400 has a spout 500 that is similar to the spout 200 of the blank 10 of the previous embodiments. That is, the second embodiment is like the first embodiment, except for variations noted, and variations that will be apparent to one of ordinary skill in the art. Accordingly, similar or identical features of the embodiments are provided with corresponding or similar reference numbers (e.g., reference numbers for features of the second embodiment that correspond to like or similar features of the first embodiment can have a "4" or "5" prefix).

The blank 400 has an exterior surface 402 and an opposing interior surface 405. The blank 400 has a first side panel 406, a first end panel 408, a second side panel 410, a second end panel 412, a first support panel 414, and a second support panel 416. The lateral fold lines 418, 420, 422, 424, 426 respectively foldably connect adjacent panels 406, 408, 410, 412, 414, and 416. Top end flaps 428, 430, 432, 434 are respectively foldably connected to one of the panels 406, 408 410, 412 at respective longitudinal fold lines 436, 438, 440, 442. Bottom end flaps 444, 446, 448, 450 are foldably connected to one of the panels 406, 408, 410, 412 at a respective longitudinal fold line 452, 454, 456, 458. The panels 406, 408, 410, 412, 414 and end flaps 428, 430, 432, 434, 444, 446, 448, 450 have similar features, dimensions, and characteristics as the corresponding panels and end flaps of the blank 10 of the first embodiment.

Figure 6:
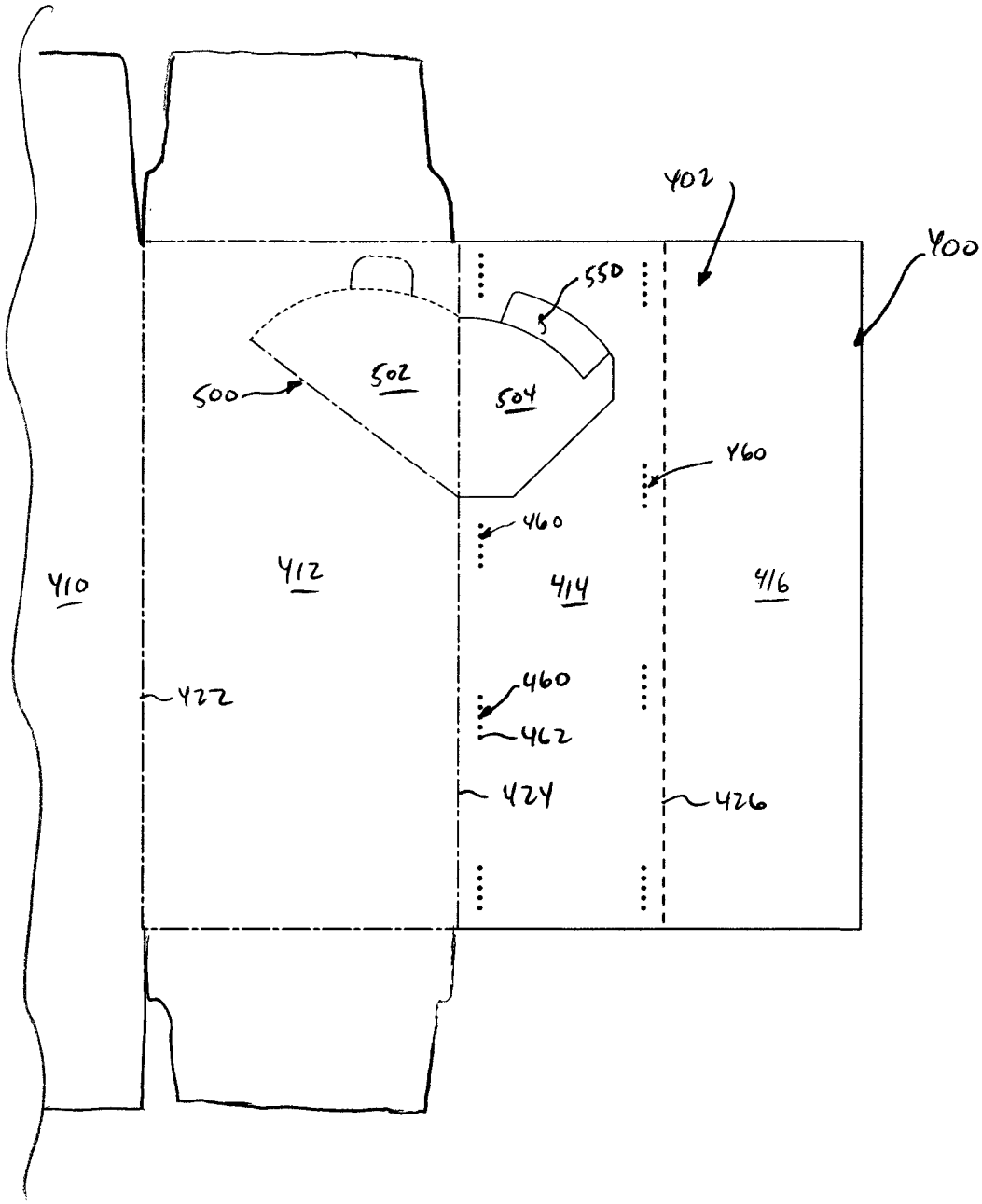
FIG. 6 is a plan view of an exterior surface of a portion of the blank shown in FIG. 4.

As shown in FIGS. 4-6, the spout 500 includes a first spout panel 502 and a second spout panel 504 foldably connected to the first spout along a portion 506 of the fold line 424. In the embodiment of FIGS. 4-6, the first spout panel 502 is formed from a portion of the end panel 412 and the second spout panel 504 is formed from a portion of the first support panel 414. The portion 506 of the fold line 424 has a first end 508 and an opposing second end 510.

The first spout panel 502 is formed by the spout fold line 512, the curved tear line 514, and the portion 506 of the fold line 424. An access flap 520 is located in the side panel 412 adjacent to a top edge of the first spout panel 502. The second spout panel 504 is defined by the portion 506 of the fold line 424, the tear line 532, the oblique tear line 534, the curved tear line 536, a lateral tear line 540, a short oblique tear line 544 adjacent the lateral tear line 540, and the opening 550 in the first support panel 414. As in the previous embodiment, the opening 550 is a generally trapezoidal-shaped and is defined by curved parallel edges 558, 559 and oblique edges 556, 560 of the first support panel 414.

In the embodiment of FIGS. 4-6, the second spout panel 504 has a retention tab 538 that is generally triangular-shaped. The retention tab 538 is partially defined by the lateral tear line 540, the short tear line 544, and the oblique edge 556 forming the opening 550. The retention tab 538 has an edge 542 that is generally parallel to the fold lines 424, 426 and substantially perpendicular to the tear line 532.

The opening 554 is sized to receive the retention tab 538 such that the edge 556 of the retention tab can contact the oblique edge 560 in the open position of the spout 500 to prevent the spout from being further withdrawn from the carton 100. As with the previous embodiment, one or more of the first spout panel 502, the second spout panel 504, the access flap 520, the retention tab 538, and the opening 554 could be otherwise shaped, arranged, and/or omitted without departing from the disclosure.

Figure 11:
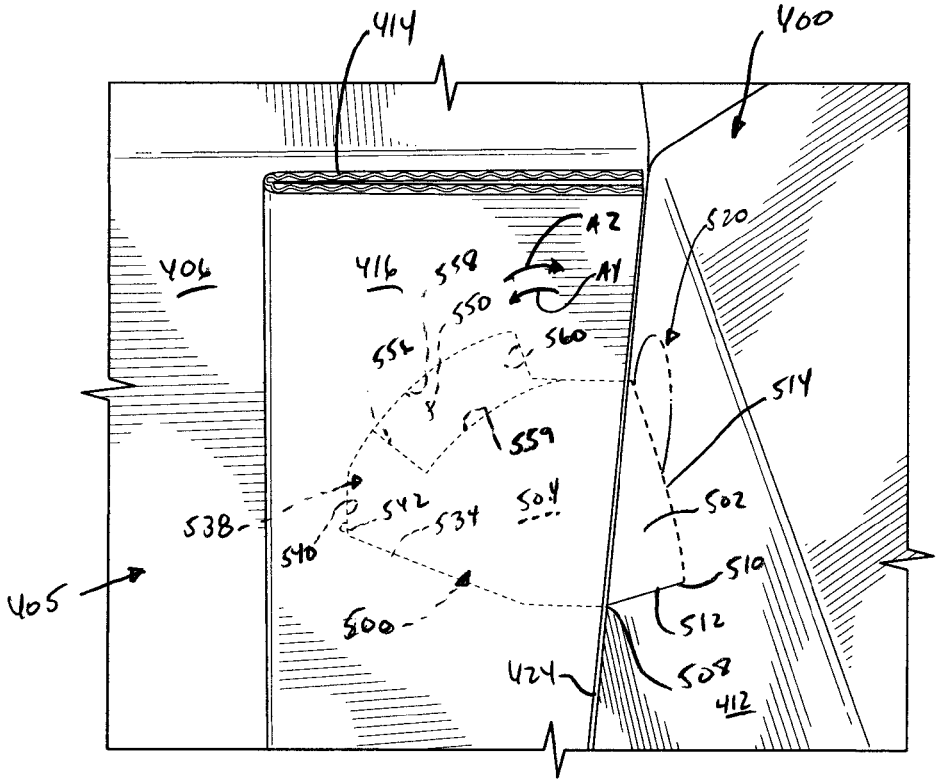
FIG. 11 is a perspective of the interior of the carton formed from the blank of FIG. 4 with the spout in the closed position.
Figure 12:
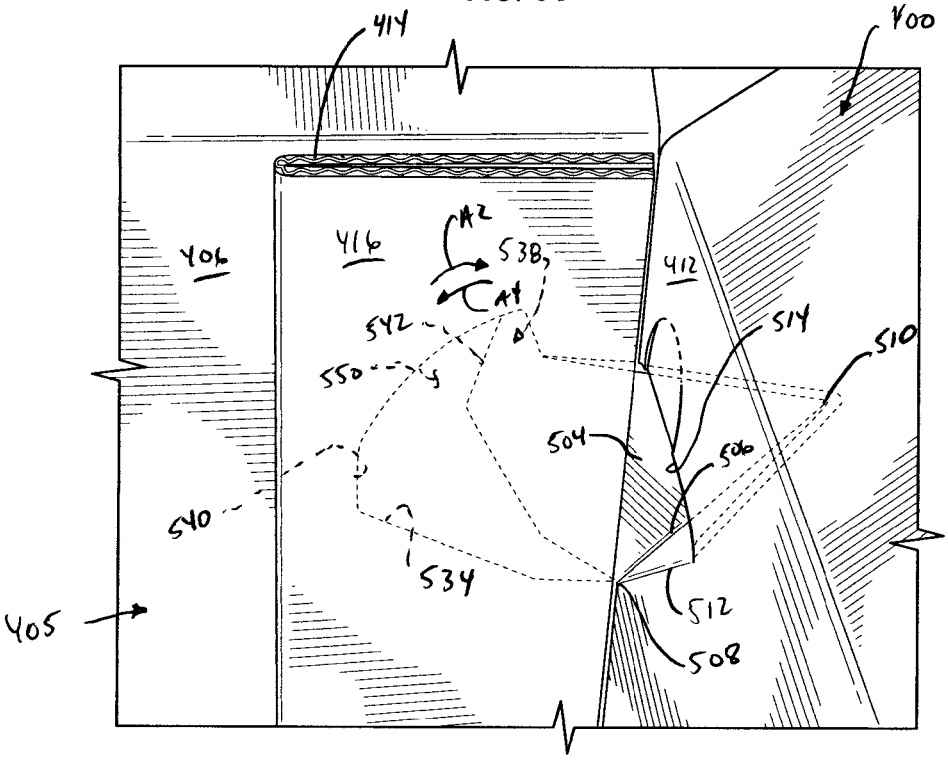
FIG. 12 is a perspective of the interior of the carton of FIG. 11 with the spout in the open position.

The blank 400 can be formed into a carton 100 in a similar manner as the blank 10 of the first embodiment. Further, the spout 500 can be positioned between the open position (FIG. 10) and the closed position (FIG. 11) in a similar manner as described above for the spout 200 of the first embodiment. Dispensable material can be removed via the spout 500 by a user in a similar manner as described above for the first embodiment. The spout 500 could be opened and/or closed by other methods, and/or positioning steps and the spout 500 could have other features without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In one embodiment, the carton includes a marking thereon including, without limitation, indicia that identifies the product, a manufacturer of the product and/or seller of the product. For example, the marking may include printed text that indicates a product's name and briefly describes the product, logos and/or trademarks that indicate a manufacturer and/or seller of the product, and/or designs and/or ornamentation that attract attention.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a dispensable material, the carton comprising:

a plurality of panels that extends at least partially around an interior of the carton, the plurality of panels comprising a first panel and a second panel foldably connected to the first panel at a fold line;

a spout at least partially formed in the first panel and the second panel, the spout being moveable between a closed position substantially preventing removal of dispensable material from the carton and an open position allowing removal of the dispensable material from the carton; and the spout comprising a first spout panel formed from a portion of the first panel and a second spout panel formed from a portion of the second panel, and the second spout panel being foldably connected to the first spout panel at at least a portion of the fold line, the second spout panel comprises a retention tab, and the second panel comprises an opening adjacent the retention tab, the opening comprising an upper curved side edge, a lower curved side edge, a first end edge forming a stopper surface at one end of the upper curved side edge and the lower curved side edge, and a second end edge forming a side edge of the retention tab at the other end of the upper curved side edge and the lower curved side edge, the upper curved side edge and the lower curved side edge being generally parallel, the retention tab being in slidable engagement with the upper curved side edge in said closed position of said spout and during movement of said spout from said closed position to said open position of said spout.

2. The carton of claim 1 wherein the fold line is located at a corner of the carton.

3. The carton of claim 1 wherein the first spout panel is foldably connected to the first panel at a spout fold line.

4. The carton of claim 3 wherein the fold line is a lateral fold line.

5. The carton of claim 4 wherein the spout fold line is an oblique fold line, and the spout fold line and the lateral fold line intersect at a junction.

6. The carton of claim 5 wherein the first spout panel is separable along a top edge at a curved tear line in the first panel.

7. The carton of claim 1 wherein the second spout panel is separable from the second panel at a tear line.

8. The carton of claim 1 wherein the stopper surface is for engaging the retention tab in the open position of the spout to prevent further opening of the spout.

9. The carton of claim 8 wherein the retention tab moves in the opening when the spout is moved from the closed position to the open position, the retention tab sliding along the upper curved side edge when moving from the closed position to the open position.

10. The carton of claim 1 wherein the first spout panel is generally triangular-shaped, and the second spout panel is generally triangular-shaped.

11. The carton of claim 1 further comprising an access panel in the first panel for accessing the first spout panel and initiating movement of the spout from the closed position to the open position, the first spout panel being defined by a curved tear line in the first panel, the access panel being foldably connected to the first panel for grasping an edge of the first spout panel corresponding to the curved tear line.

12. The carton of claim 1 wherein the plurality of panels comprises a third panel foldably connected to the second panel, and the second spout panel is in face-to-face contact with the third panel and capable of sliding movement relative to the third panel when the spout is moved between the closed position and the open position.

13. The carton of claim 1 wherein the plurality of panels comprises a first side panel, a first end panel foldably connected to the first side panel, a second side panel foldably connected to the first end panel, a second end panel foldably connected to the second side panel, a first support panel foldably connected to the second end panel, and a second support panel foldably connected to the first support panel, and the first panel is the second end panel and the second panel is the first support panel.

14. The carton of claim 13 wherein the second support panel and the first side panel cooperate to form a sleeve for receiving the second spout panel.

15. The carton of claim 1 wherein the retention tab has a top edge, the top edge being in slidable engagement with the upper curved edge.

16. The carton of claim 1 wherein the retention tab is generally square-shaped.

17. A blank for forming a carton for containing a dispensable material, the blank comprising:

a plurality of panels that comprises a first panel and a second panel foldably connected to the first panel at a fold line;

a spout at least partially formed in the first panel and the second panel, the spout being moveable between a closed position substantially preventing removal of dispensable material from the carton formed from the blank and an open position allowing removal of the dispensable material from the carton formed from the blank;

the spout comprising a first spout panel formed from a portion of the first panel and a second spout panel formed from a portion of the second panel, and the second spout panel being foldably connected to the first spout panel at at least a portion of the fold line, the second spout panel comprises a retention tab, and the second panel comprises an opening adjacent the retention tab, the opening comprising an upper curved side edge, a lower curved side edge, a first end edge forming a stopper surface at one end of the upper curved side edge and the lower curved side edge, and a second end edge forming a side edge of the retention tab at the other end of the upper curved side edge and the lower curved side edge, the upper curved side edge and the lower curved side edge being generally parallel, the retention tab being in slidable engagement with the upper curved edge.

18. The blank of claim 17 wherein the first spout panel is foldably connected to the first panel at a spout fold line.

19. The blank of claim 18 wherein the fold line is a lateral fold line and the spout fold line is an oblique fold line, and the spout fold line and the lateral fold line intersect at a junction.

20. The blank of claim 19 wherein the first spout panel is separable along a top edge at a curved tear line in the first panel, and the second spout panel is separable from the second panel at a tear line.

21. The blank of claim 17 wherein the first spout panel is generally triangular-shaped, and the second spout panel is generally triangular-shaped.

22. The blank of claim 17 wherein the plurality of panels comprises a third panel foldably connected to the second panel, and the third spout panel is foldably positionable to be in face-to-face contact with the second panel when the carton is formed from the blank.

23. A method of forming a carton comprising:

obtaining a blank, the blank comprising a plurality of panels that comprises a first panel and a second panel foldably connected to one another at a fold line, a spout at least partially formed in the first panel and the second panel, the spout being moveable between a closed position substantially preventing removal of dispensable material from the carton formed from the blank and an open position allowing removal of the dispensable material from the carton formed from the blank, the spout comprising a first spout panel formed from a portion of the first panel and a second spout panel formed from a portion of the second panel and the second spout panel being foldably connected to the first spout panel at at least a portion of the fold line, the second spout panel comprises a retention tab, and the second panel comprises an opening adjacent the retention tab, the opening comprising an upper curved side edge, a lower curved side edge, a first end edge forming a stopper surface at one end of the upper curved side edge and the lower curved side edge, and a second end edge forming a side edge of the retention tab at the other end of the upper curved side edge and the lower curved side edge, the upper curved side edge and the lower curved side edge being generally parallel, the retention tab being in slidable engagement with the upper curved side edge;

folding the blank to form a carton, the folding the blank comprising positioning the plurality of panels to form an interior space; and filling the interior space with a dispensable material.

24. The method of claim 23 wherein the plurality of panels comprises a first side panel, a first end panel foldably connected to the first side panel, a second side panel foldably connected to the first end panel, a second end panel foldably connected to the second side panel, a first support panel foldably connected to the second end panel, and a second support panel foldably connected to the first support panel, and the first panel is the second end panel and the second panel is the first support panel, and the folding the blank to form the carton comprises folding the plurality of panels to form a generally parallelepipedal-shaped carton having at least one corner, and the spout being generally located at the corner of the carton.

25. The method of claim 24 wherein the folding the blank to form the carton comprises forming a sleeve for receiving the second spout panel.

26. The method of claim 25 wherein the forming the sleeve comprises folding the second support panel to be in face-to-face contact with at least a portion of the first support panel, and folding the first support panel to be in face-to-face contact with at least a portion of the first side panel.

27. The method of claim 23 further comprising opening the spout by folding the first spout panel outward from the first panel, the opening the spout comprises sliding the retention tab in the opening, a top surface of the retention tab being in sliding contact with the upper curved edge during the opening the spout.

28. The method of claim 27 further comprising fully opening the spout by engaging the retention tab with the stopper wall.

29. The method of claim 28 further comprising closing the spout by folding the first spout panel inward toward the first end panel, the closing the spout comprises sliding the retention tab in the opening, the top surface of the retention tab being in sliding contact with the upper curved edge during the closing the spout.

30. A carton for containing a dispensable material, the carton comprising:

a plurality of panels that extends at least partially around an interior of the carton, the plurality of panels comprising a first panel and a second panel foldably connected to the first panel at a fold line;

a spout at least partially formed in the first panel and the second panel, the spout being moveable between a closed position substantially preventing the removal of dispensable material from the carton and an open position allowing removal of the dispensable material from the carton;

the spout comprising a first spout panel formed from a portion of the first panel and a second spout panel formed from a portion of the second panel, the second spout panel being foldably connected to the first spout panel at at least a portion of the fold line, and the at least a portion of the fold line being located at a corner of the carton; and the first spout panel being foldably connected to the first panel at a spout fold line, and the spout fold line intersecting the at least a portion of the fold line at a junction, the second spout panel comprises a retention tab, and the second panel comprises an opening adjacent the retention tab, the opening comprising an upper curved side edge, a lower curved side edge, a first end edge forming a stopper surface at one end of the upper curved side edge and the lower curved side edge, and a second end edge forming a side edge of the retention tab at the other end of the upper curved side edge and the lower curved side edge, the upper curved side edge and the lower curved side edge being generally parallel, the retention tab being in slidable engagement with the upper curved side edge in said closed position of said spout and during movement of said spout from said closed position to said open position of said spout.

31. The carton of claim 30 wherein the at least a portion of the fold line extends in a lateral direction, and the spout fold line is generally oblique relative to the at least a portion of the fold line.

32. The carton of claim 30 wherein the second spout panel comprises a retention tab, the carton further comprises an opening in the second panel adjacent the retention tab, and the carton further comprises a stopper surface in the second panel adjacent the opening is for contacting the retention tab in the open position of the spout to prevent further opening the spout.

33. The carton of claim 30 further comprising a third panel foldably connected to the second panel, the second spout panel being in face-to-face contact with the third panel and capable of sliding movement relative to the third panel when the spout is moved between the closed position and the open position.

* * * * *